US012480492B2

(12) United States Patent
Okada

(10) Patent No.: US 12,480,492 B2
(45) Date of Patent: Nov. 25, 2025

(54) SCREW COMPRESSOR AND REFRIGERATION APPARATUS

(71) Applicant: DAIKIN INDUSTRIES, LTD., Osaka (JP)

(72) Inventor: Tadashi Okada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/892,129

(22) Filed: Sep. 20, 2024

(65) Prior Publication Data

US 2025/0012279 A1 Jan. 9, 2025

Related U.S. Application Data

(63) Continuation of application No. PCT/JP2023/005938, filed on Feb. 20, 2023.

(30) Foreign Application Priority Data

Mar. 28, 2022 (JP) ..... 2022-051422

(51) Int. Cl.
*F04C 18/16* (2006.01)
*F25B 31/02* (2006.01)

(52) U.S. Cl.
CPC ..... *F04C 18/16* (2013.01); *F25B 31/026* (2013.01)

(58) Field of Classification Search
CPC ..... F04C 18/16; F25B 31/026
See application file for complete search history.

(56) References Cited

U.S. PATENT DOCUMENTS 3,945,778 A * 3/1976 Zimmern ..... F01C 3/025 74/425
6,398,532 B1 * 6/2002 Zha ..... F04C 18/56 74/458

(Continued)

FOREIGN PATENT DOCUMENTS

CN 1448638 A 10/2003
CN 101424266 A 5/2009

(Continued)

OTHER PUBLICATIONS

English Translation of JP2011-21574 (Year: 2011).*

(Continued)

*Primary Examiner* — Connor J Tremarche
(74) *Attorney, Agent, or Firm* — GLOBAL IP COUNSELORS, LLP

(57) ABSTRACT

A screw compressor includes a screw rotor having a plurality of helical grooves, and a gate rotor with gates to mesh with the helical grooves. Each of the gates first and second seal lines to come into contact with side wall surfaces of the helical grooves. Shapes of the first and second seal lines are asymmetric with respect to a first imaginary straight line passing through a rotation center of the gate rotor and a first intermediate position located on a tip end side of each of the gates between the first and second seal lines. A second imaginary straight line passing through the rotation center and a second intermediate position located on a base end side of each of the gates between the first and second seal lines is inclined with respect to the first imaginary straight line. The helical grooves have shapes corresponding to the gates.

7 Claims, 11 Drawing Sheets

(56) References Cited

U.S. PATENT DOCUMENTS

| | | | |
|---|---|---|---|
| 2011/0097232 | A1 | 4/2011 | Miyamura et al. |
| 2016/0230869 | A1 | 8/2016 | Liu et al. |
| 2019/0331114 | A1 | 10/2019 | Shikano et al. |
| 2023/0015175 | A1 | 1/2023 | Fukuda et al. |

FOREIGN PATENT DOCUMENTS

| | | | | | |
|---|---|---|---|---|---|
| CN | 102102670 | A | | 6/2011 | |
| JP | 2001-153074 | A | | 6/2001 | |
| JP | 4229213 | B1 | | 12/2008 | |
| JP | 2011021574 | A | * | 2/2011 | |
| JP | 2021-142592 | A | | 9/2021 | |
| JP | 2021-162021 | A | | 10/2021 | |
| WO | 2009/028127 | A1 | | 3/2009 | |
| WO | WO-2010072138 | A1 | * | 7/2010 | ..... F01C 3/025 |

OTHER PUBLICATIONS

English Translation of WO 2010/072138 (Year: 2010).*
International Search Report of corresponding PCT Application No. PCT/JP2023/011543 dated May 16, 2023.
International Search Report of corresponding PCT Application No. PCT/JP2023/005938 dated May 16, 2023.
International Preliminary Report of corresponding PCT Application No. PCT/JP2023/005938 dated Oct. 10, 2024.
European Search Report of corresponding EP Application No. 23 77 9018.3 dated May 21, 2025.
Shen Lili et al.; "Theoretical and experimental analyses of the internal leakage in single-screw expanders", International Journal of Refrigeration, Amsterdam, NL, vol. 86, Nov. 2017, pp. 273-281.

* cited by examiner

COMPARATIVE EXAMPLE

SCREW COMPRESSOR AND REFRIGERATION APPARATUS

CROSS-REFERENCE TO RELATED APPLICATIONS

This is a continuation of International Application No. PCT/JP2023/005938 filed on Feb. 20, 2023, which claims priority to Japanese Patent Application No. 2022-051422, filed on Mar. 28, 2022. The entire disclosures of these applications are incorporated by reference herein.

BACKGROUND

Technical Field

The present disclosure relates to a screw compressor and a refrigeration apparatus.

Background Art

Japanese Patent No. 4229213 describes that a screw rotor for a screw compressor is manufactured by using a 5-axis machining center. In a 5-axis machining center, a workpiece is cut while a cutting tool, such as an end mill, attached to a spindle and the workpiece attached to a holder are both moved.

SUMMARY

Depending on the groove shapes of helical grooves, the relative angle of a cutting tool with respect to the center axis of a screw rotor may become large. Particularly when cutting axial ends of the helical grooves, there is a possibility that a spindle of a 5-axis machining center and a rotary table of the 5-axis machining center will interfere with each other.

An object of the present disclosure is to refine the shapes of gates so as to avoid interference between a spindle and a rotary table when machining helical grooves that correspond to the gates by using a 5-axis machining center.

A first aspect of the present disclosure is a screw compressor including a screw rotor having a plurality of helical grooves, and a gate rotor including gates configured to mesh with the helical grooves of the screw rotor. Each of the gates has a first seal line and a second seal line, with each configured to come into contact with side wall surfaces of the helical grooves of the screw rotor. A shape of the first seal line and a shape of the second seal line are asymmetric with respect to a first imaginary straight line passing through a rotation center of the gate rotor and a first intermediate position located on a tip end side of each of the gates between the first seal line and the second seal line. A second imaginary straight line passes through the rotation center of the gate rotor and a second intermediate position located on a base end side of each of the gates between the first seal line and the second seal line. The second imaginary straight line is inclined at a predetermined angle with respect to the first imaginary straight line. Each of the helical grooves has a shape corresponding to each of the gates.

DETAILED DESCRIPTION OF EMBODIMENT(S)

First Embodiment

Figure 1:
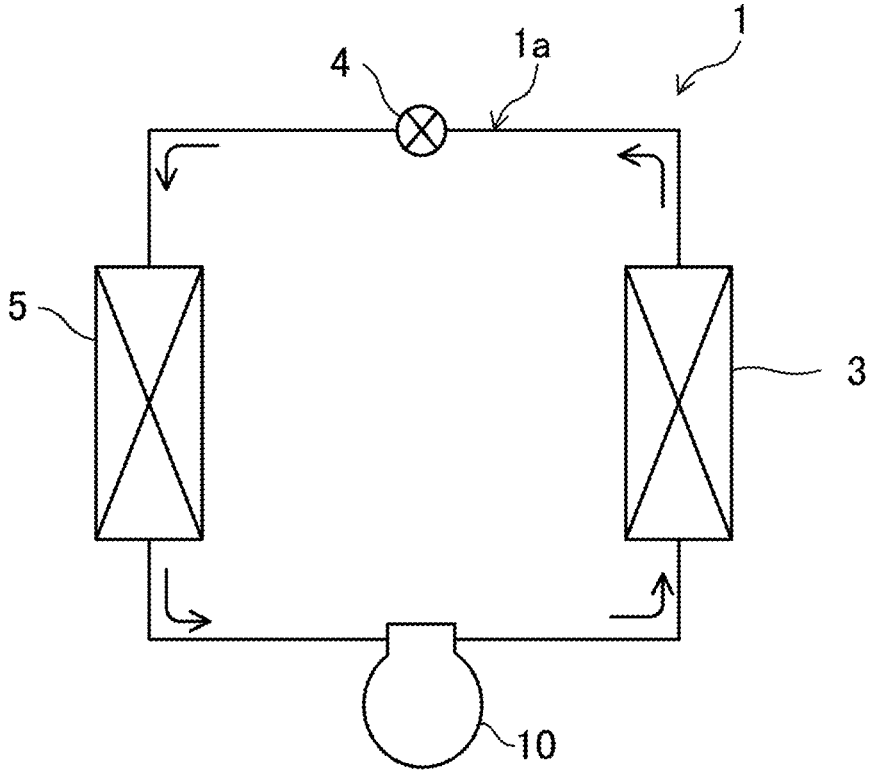
FIG. 1 is a refrigerant circuit diagram illustrating a configuration of a refrigeration apparatus of a first embodiment.

As illustrated in FIG. 1, a screw compressor (10) is included in a refrigeration apparatus (1). The refrigeration apparatus (1) includes a refrigerant circuit (1*a*) filled with a refrigerant. The refrigerant circuit (1*a*) includes the screw compressor (10), a radiator (3), a decompression mechanism (4), and an evaporator (5). The decompression mechanism (4) is, for example, an expansion valve. The refrigerant circuit (1*a*) performs a vapor compression refrigeration cycle.

The refrigeration apparatus (1) is an air-conditioning device. The air-conditioning device may be a cooling-only device, a heating-only device, or an air-conditioning device that switches between cooling and heating. In this case, the air-conditioning device includes a switching mechanism (e.g., a four-way switching valve) that switches a direction in which the refrigerant circulates. The refrigeration apparatus (1) may be, for example, a water heater, a chiller unit, or a cooling apparatus that cools the air therein. The cooling apparatus cools the air inside a refrigerator, a freezer, a container, or the like.

Overall Configuration of Screw Compressor

Figure 2:
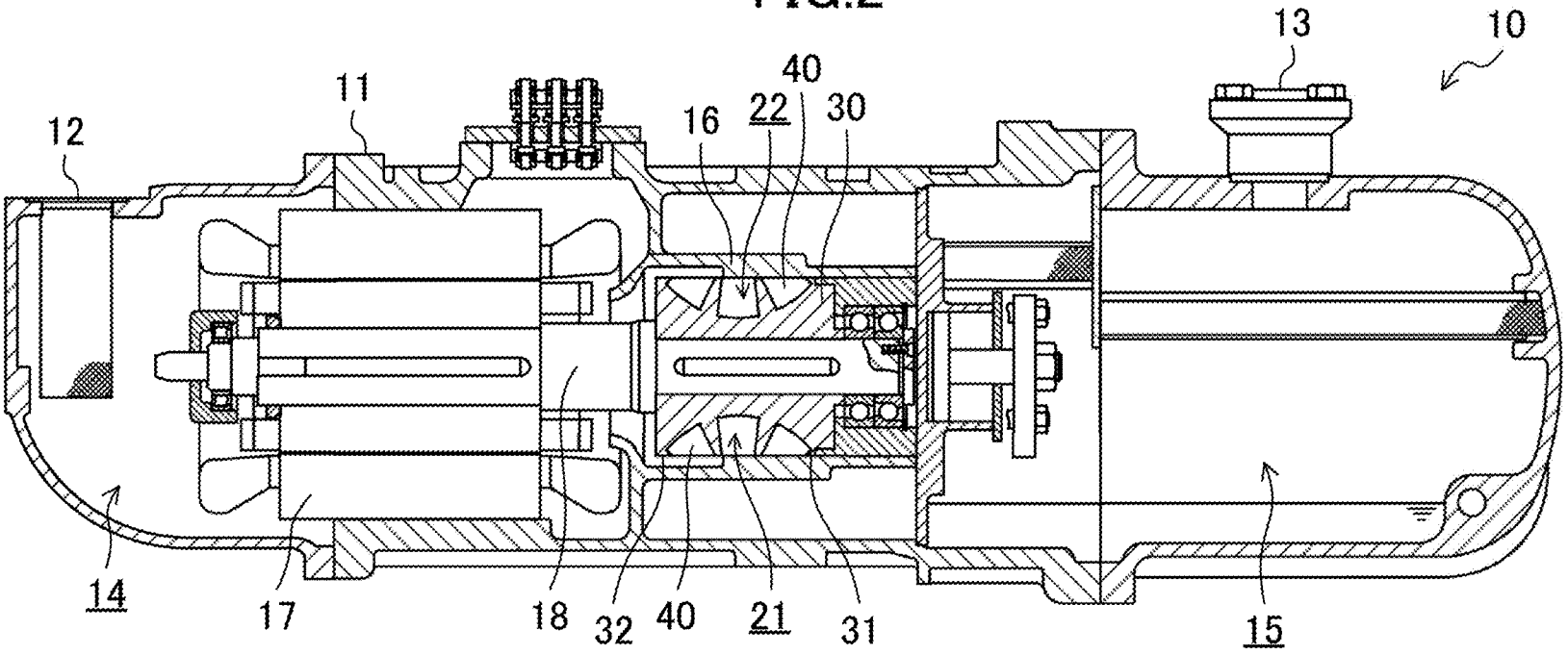
FIG. 2 is a longitudinal sectional view illustrating a configuration of a screw compressor.
Figure 3:
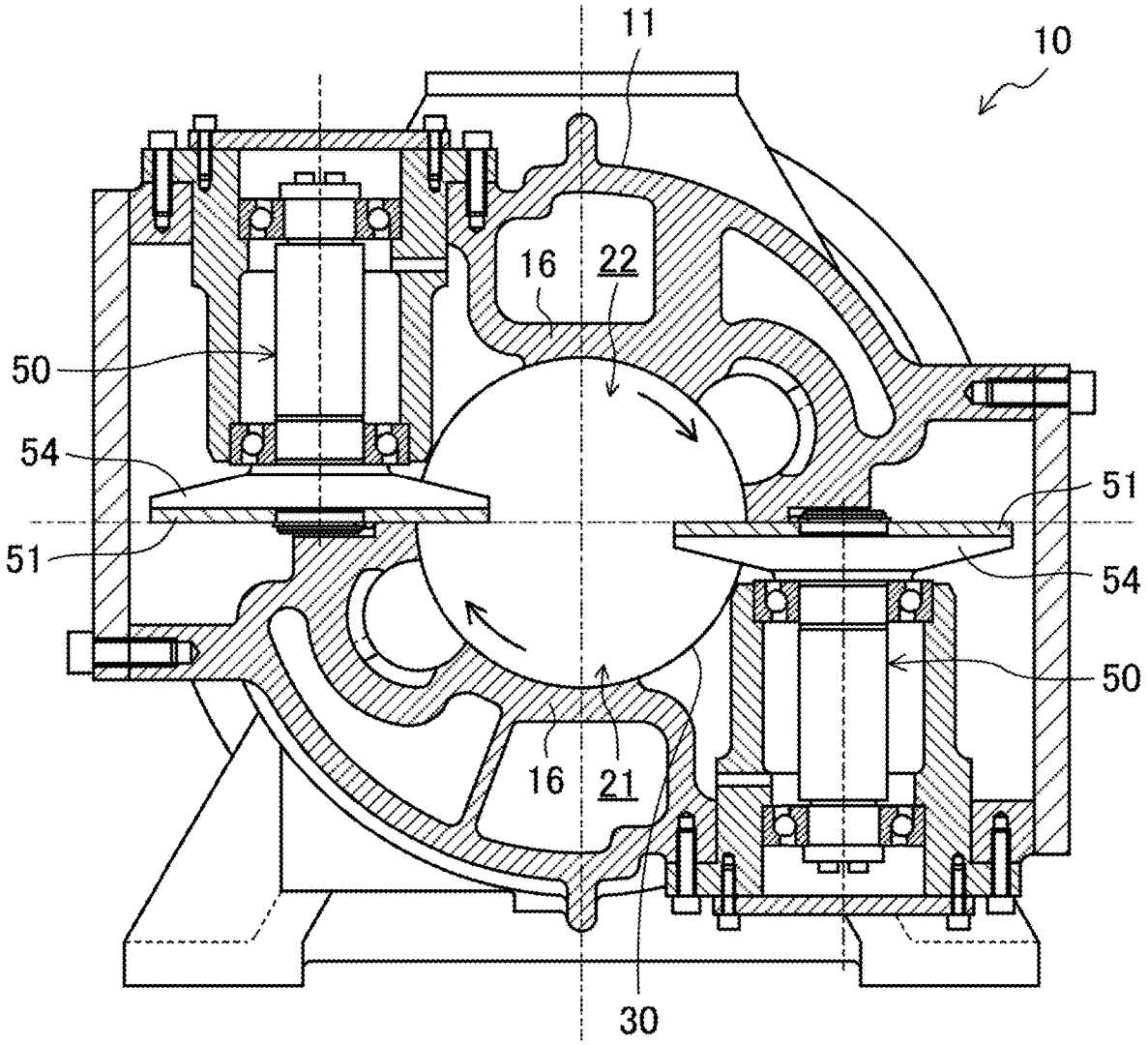
FIG. 3 is a cross-sectional view illustrating the configuration of the screw compressor as viewed from a high-pressure chamber side.

As illustrated in FIG. 2 and FIG. 3, the screw compressor (10) includes a single screw rotor (30) and two gate rotor assemblies (50). The screw compressor (10) includes a casing (11), an electric motor (17), and a drive shaft (18).

As illustrated in FIG. 2, the casing (11) is formed in a cylindrical shape with both ends closed. The casing (11) is positioned such that the longitudinal direction thereof is a substantially horizontal direction. The casing (11) includes a cylindrical portion (16). The cylindrical portion (16) is a portion that is formed in a cylindrical shape. The cylindrical portion (16) is positioned in the vicinity of the center of the casing (11) in the longitudinal direction. The screw rotor (30) is accommodated in the cylindrical portion (16).

The casing (11) has a suction port (12) and a discharge port (13). The suction port (12) is formed at an upper portion of a first end portion (a left end portion in FIG. 2) of the casing (11). The discharge port (13) is formed in an upper portion of a second end portion (a right end portion in FIG. 2) of the casing (11).

The casing (11) includes a low-pressure chamber (14) and a high-pressure chamber (15) formed therein. The low-pressure chamber (14) is formed closer to the first end of the casing (11) than the cylindrical portion (16) is and communicates with the suction port (12). The high-pressure chamber (15) is formed closer to the second end of the casing (11) than the cylindrical portion (16) is and communicates with the discharge port (13).

The electric motor (17) is disposed in the low-pressure chamber (14). The drive shaft (18) connects the electric motor (17) and the screw rotor (30) to each other. The electric motor (17) drives the screw rotor (30) so that the screw rotor (30) rotates.

As illustrated in FIG. 3, each of the gate rotor assemblies (50) includes a gate rotor (51) and a support (54). Each of the gate rotors (51) is a member that is made of a resin and that has a flat plate-like shape. Each of the supports (54) is a member made of a metal. Each of the supports (54) is provided so as to be in contact with a rear surface of the corresponding gate rotor (51) and supports the gate rotor (51).

In FIG. 3, in one of the gate rotor assemblies (50) that is located on the right-hand side of the screw rotor (30), a front surface of the gate rotor (51) faces upward. In addition, in FIG. 3, in the other of the gate rotor assemblies (50) that is located on the left-hand side of the screw rotor (30), a front surface of the gate rotor (51) faces downward.

Screw Rotor

Figure 4:
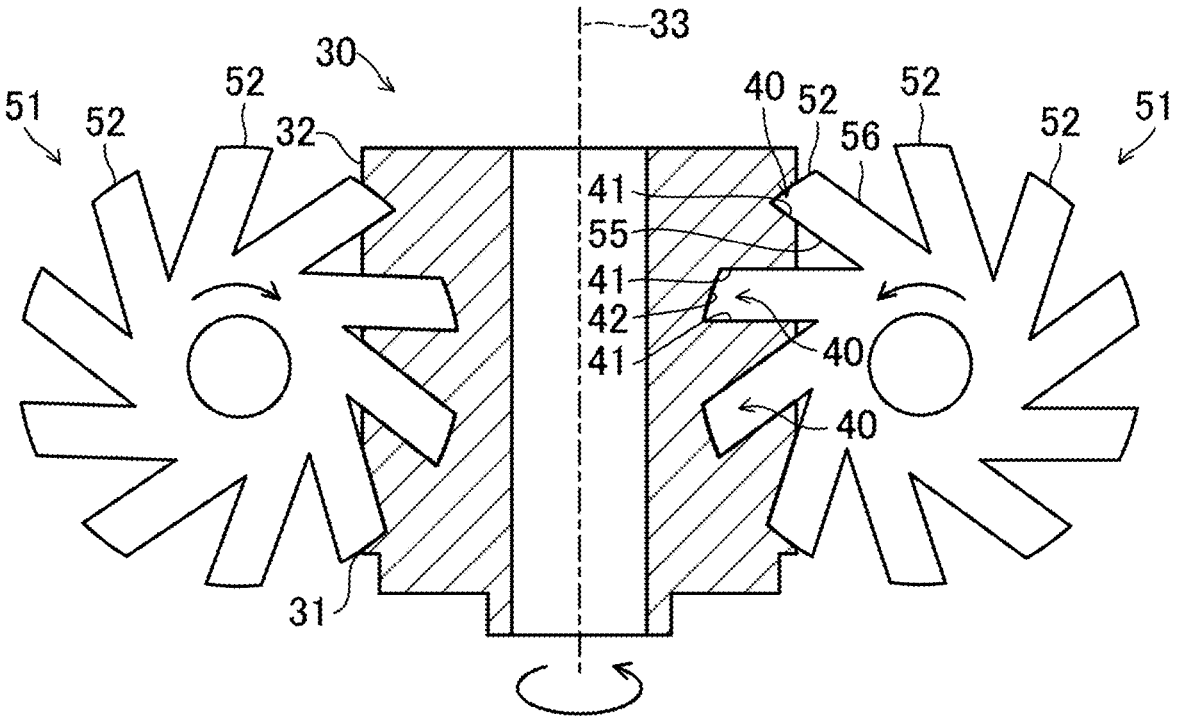
FIG. 4 is a plan view illustrating an arrangement of a screw rotor and gate rotors.

As illustrated in FIG. 4, the screw rotor (30) is a member that is made of a metal and that has a cylindrical shape. In the axial direction of the screw rotor (30), a first seal end portion (31) is provided at one end of the screw rotor (30), and a second seal end portion (32) is provided at the other end of the screw rotor (30). The lower end portion of the screw rotor (30) in FIG. 4 corresponds to the first seal end portion (31), and the upper end portion of the screw rotor (30) in FIG. 4 corresponds to the second seal end portion (32). In the cylindrical portion (16) of the casing (11), the first seal end portion (31) of the screw rotor (30) is located on the high-pressure chamber (15) side, and the second seal end portion (32) of the screw rotor (30) is located on the low-pressure chamber (14) side.

The screw rotor (30) has a plurality of helical grooves (40). The helical grooves (40) are formed in an outer peripheral portion of the screw rotor (30). The helical grooves (40) extend in a helical manner in a direction in which a center axis (33) of the screw rotor (30) extends. The helical grooves (40) are formed between the first seal end portion (31) and the second seal end portion (32). The helical grooves (40) are open only at the outer peripheral surface of the screw rotor (30). Therefore, in the screw rotor (30) of the present embodiment, each of the helical grooves (40) is not open at an end surface of the screw rotor (30). Each of the helical grooves (40) has side wall surfaces (41) and a bottom wall surface (42).

Gate Rotor

As illustrated in FIG. 4, each of the gate rotors (51) includes a plurality of gates (52) that are arranged in such a manner as to be spaced apart from each other in a circumferential direction. Each of the gates (52) is a substantially rectangular flat plate-shaped portion. The gates (52) enter the helical grooves (40) of the screw rotor (30) and slide on wall surfaces of the helical grooves (40) so as to form a first compression chamber (21) and a second compression chamber (22). Note that the detailed shape of each of the gate rotors (51) will be described later.

Each of the gates (52) has a first seal line (55) and a second seal line (56) each of which formed at a side surface thereof. The first seal lines (55) and the second seal lines (56) are each a linear region extending from a base end of the corresponding gate (52) toward a tip end of the gate (52). When one of the gates (52) enters one of the helical grooves (40), the corresponding first seal line (55) and the corresponding second seal line (56) slide along the side wall surfaces (41) of the helical groove (40).

When the screw rotor (30) rotates, the gate rotors (51) rotate along with the rotation of the screw rotor (30). In FIG. 4, the gate rotor (51) on the right-hand side rotates in the counterclockwise direction. The other gate rotor (51) on the left-hand side rotates in the clockwise direction.

Compression Chamber

As illustrated in FIG. 2 and FIG. 3, in the screw compressor (10), the screw rotor (30), the gate rotors (51), and the cylindrical portion (16) of the casing (11) form the first compression chamber (21) and the second compression chamber (22). The first compression chamber (21) and the second compression chamber (22) are closed spaces that are surrounded by the wall surfaces of the helical grooves (40) of the screw rotor (30), the front surfaces of the gates (52) of the gate rotors (51), and the inner peripheral surface of the cylindrical portion (16).

In the screw compressor (10) of the present embodiment, a compression chamber that is located below the screw rotor (30) in FIG. 3 corresponds to the first compression chamber (21), and a compression chamber that is located above the screw rotor (30) in FIG. 3 corresponds to the second compression chamber (22).

Operation of Screw Compressor

In the screw compressor (10), the screw rotor (30) is driven by the electric motor (17). When the screw rotor (30) rotates, the gate rotors (51) meshing with the screw rotor (30) rotate. When the gate rotors (51) rotate, the gates (52) of the gate rotors (51) enter the helical grooves (40) of the screw rotor (30) and relatively move from a suction-side end of the helical grooves (40) that the gates (52) have entered toward a discharge-side end of the helical grooves (40). As a result, the volume of the first compression chamber (21) and the volume of the second compression chamber (22) are gradually reduced, and the refrigerant in the first and second compression chambers (21) and (22) is compressed.

The screw compressor (10) of the present embodiment performs two-stage compression. More specifically, the refrigerant that has flowed in the low-pressure chamber (14) through the suction port (12) flows into the first compression chamber (21) and is compressed. The refrigerant compressed in the first compression chamber (21) is discharged from the first compression chamber (21) and flows into the second compression chamber (22) through a passage that is formed in the casing (11). The refrigerant that has flowed in the second compression chamber (22) is compressed and then discharged to the high-pressure chamber (15). The refrigerant that has flowed in the high-pressure chamber (15)

is discharged to the outside of the screw compressor (10) through the discharge port (13).

Method of Manufacturing Screw Rotor

A method of manufacturing the screw rotor (30) of the present embodiment will now be described.

Figure 5:
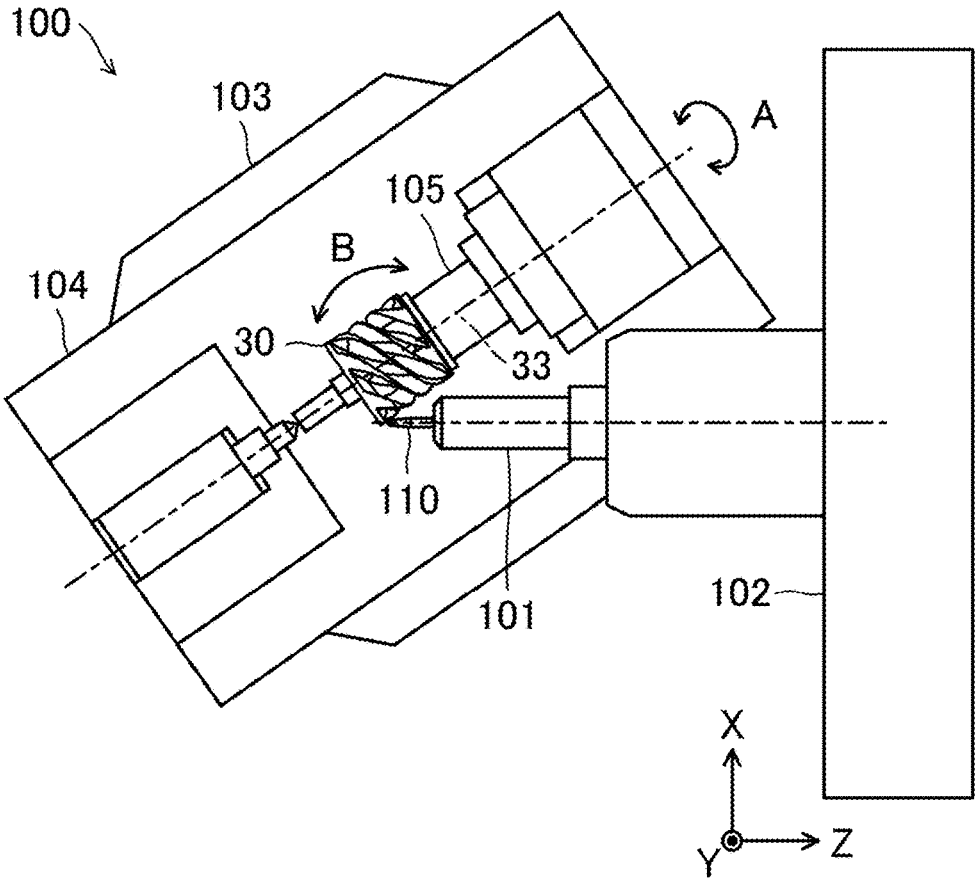
FIG. 5 is a plan view illustrating a configuration of a 5-axis machining center.

As illustrated in FIG. 5, the screw rotor (30) is processed by using a 5-axis machining center (100).

The 5-axis machining center (100) includes a spindle (101) to which a cutting tool (110), such as an end mill, is attached and a column (102) to which the spindle (101) is attached. The 5-axis machining center (100) further includes a rotary table (104) that is rotatably attached to a base table (103) and a holder (105) that is placed on the rotary table (104) so as to hold the screw rotor (30), which is a workpiece.

In the 5-axis machining center (100), three degrees of freedom are assigned to the cutting tool (110) side, and two degrees of freedom are assigned to the screw rotor (30) side. More specifically, the spindle (101) is freely movable in the X-axis direction that is orthogonal to an axis of the spindle (101), in the Y-axis direction that is orthogonal to the axis and the X-axis direction, and in the Z-axis direction that is the direction in which the axis extends.

The holder (105) is freely rotatable about its center axis (about an A-axis). The rotary table (104) to which the holder (105) is attached is freely rotatable around an axis (a B-axis) that is orthogonal to the axial direction of the holder (105).

In other words, in the 5-axis machining center (100), the cutting tool (110) is capable of performing translational movement in the X-axis direction, the Y-axis direction, and the Z-axis direction, and the screw rotor (30) is freely rotatable around the A-axis and the B-axis.

In the 5-axis machining center (100), machining of the screw rotor (30) is performed by moving the cutting tool (110) on the basis of a tool path that is provided beforehand as numerical data. The 5-axis machining center (100) sequentially performs a plurality of processes from rough cutting to a finishing step by using a plurality of types of the cutting tools (110).

Figure 6:
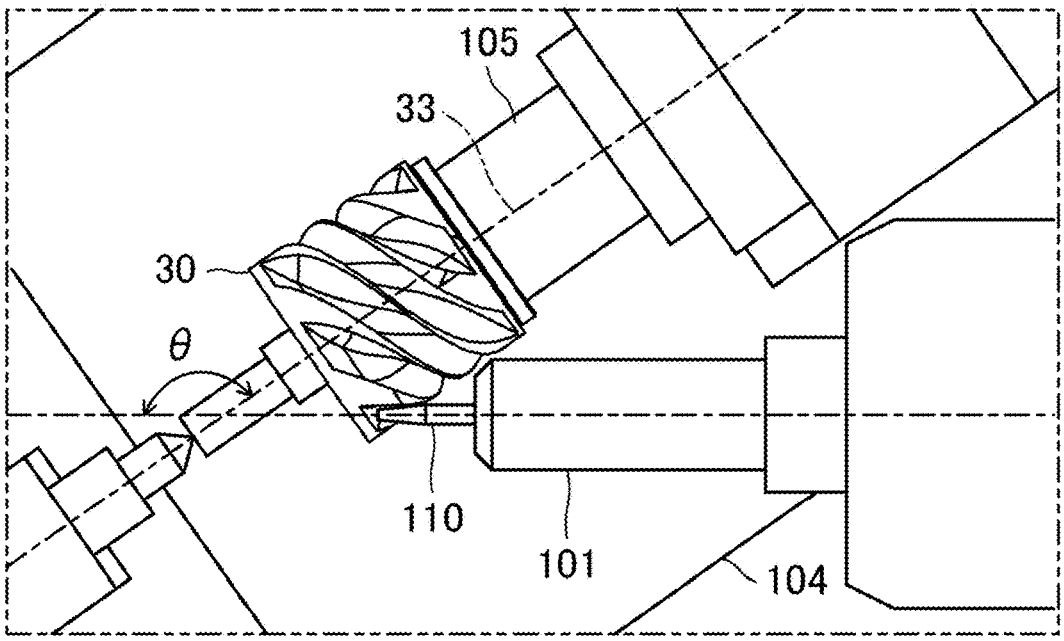
FIG. 6 is a plan view illustrating a relative angle of a cutting tool with respect to a center axis of the screw rotor.

As illustrated in FIG. 6, the relative angle θ of the cutting tool (110) with respect to the center axis (33) of the screw rotor (30) reaches its maximum value (e.g., 150 degrees) when an axial end of each of the helical grooves (40) is machined. Thus, the range of a tool orientation required for the cutting tool (110) to machine the helical grooves (40) of the general screw rotor (30) is 25 degrees to 150 degrees with respect to the center axis (33) of the screw rotor (30).

However, in the general 5-axis machining center (100), the relative angle θ of the cutting tool (110) with respect to the center axis (33) of the screw rotor (30) is within an operating range up to 135 degrees, and the holder (105) on the rotary table (104) and a main body of the spindle (101) interfere with each other.

In addition, even if the special 5-axis machining center (100) in which the relative angle θ of the cutting tool (110) with respect to the center axis (33) of the screw rotor (30) is within an operating range up to 145 degrees is used, the interference between the spindle (101) and the rotary table (104) cannot be avoided. Consequently, an additional operation to change the holding position of the screw rotor (30) with respect to the holder (105) is required during the finishing step, which increases the workload.

Accordingly, the inventors of the present application conducted studies on refining the shape of each of the gates (52) to avoid the interference between the spindle (101) and the rotary table (104) when machining each of the helical grooves (40), which correspond to the gates (52), by using the 5-axis machining center (100).

Figure 7:
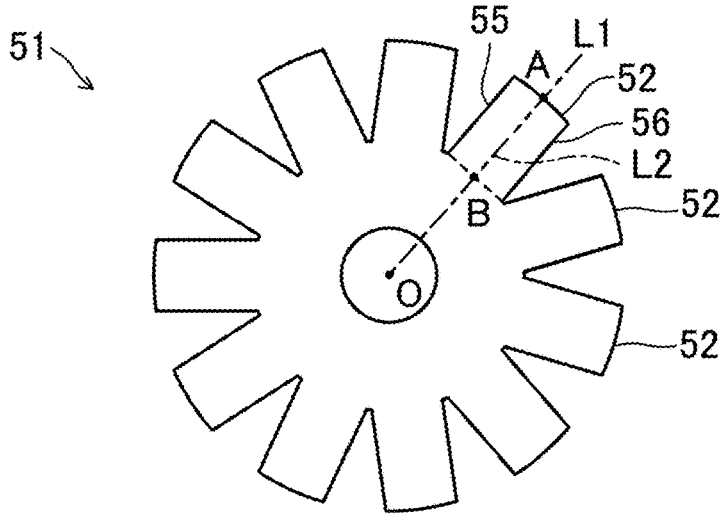
FIG. 7 is a plan view illustrating a configuration of a gate rotor as a comparative example.

First, as a comparative example, the shape of each of the general gates (52) will be described. As illustrated in FIG. 7, each of the gate rotors (51) includes the gates (52) that mesh with the helical grooves (40) of the screw rotor (30). Each of the gates (52) includes the first seal line (55) and the second seal line (56) that come into contact with the side wall surfaces (41) of the helical grooves (40) of the screw rotor (30).

In each of the gates (52), the shape of the first seal line (55) and the shape of the second seal line (56) are symmetric with respect to a first imaginary straight line (L1) passing through a rotation center (O) of the corresponding gate rotor (51) and a first intermediate position (A) that is located on the tip end side of the gate (52) between the first seal line (55) and the second seal line (56).

In addition, a second imaginary straight line (L2) passing through the rotation center (O) of a corresponding one of the gate rotors (51) and a second intermediate position (B) that is located on the base end side of the gate (52) between the first seal line (55) and the second seal line (56) coincides with the first imaginary straight line (L1). Thus, the angle formed by the first imaginary straight line (L1) and the second imaginary straight line (L2) is 0 degrees.

Figure 8:
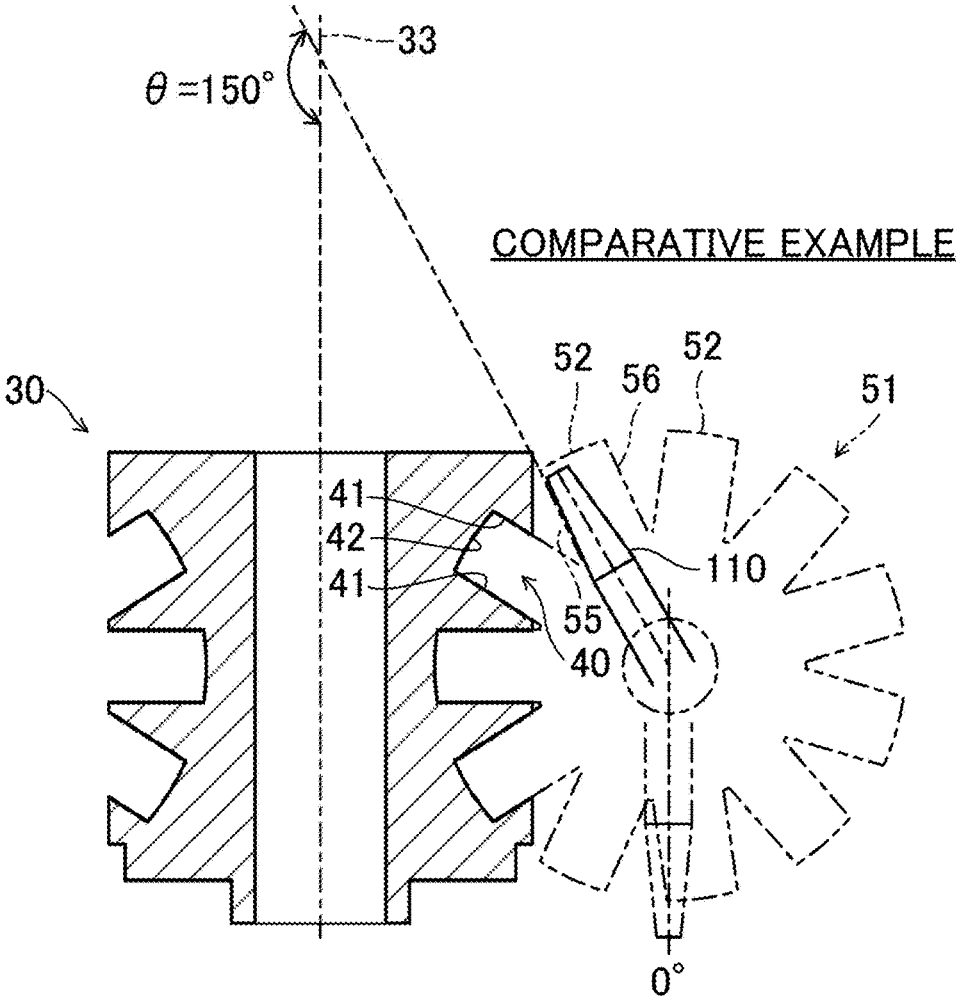
FIG. 8 is a plan view illustrating a relative angle of a cutting tool with respect to a center axis of a screw rotor as the comparative example.

As illustrated in FIG. 8, a groove machining step of forming the helical grooves (40), whose shapes correspond to the gates (52), into a cylindrical workpiece is performed. After the groove machining step, the finishing step is performed on the side wall surfaces (41) and the bottom wall surfaces (42) of the helical grooves (40) such that the shapes of the helical grooves (40) each meet the design values of the screw rotor (30). In the finishing step, swarf machining in which the screw rotor (30) is cut by using a side surface of the cutting tool (110) is performed.

Here, as illustrated in FIG. 8, assume that the relative angle θ of the cutting tool (110) with respect to the center axis (33) of the screw rotor (30) is 0 degrees when a center axis of the cutting tool (110) and the center axis (33) of the screw rotor (30) are parallel to each other while the tip of the cutting tool (110) faces downward in FIG. 8.

A maximum angle of the cutting tool (110) when machining an axial end portion of the screw rotor (30) corresponds to the shape of each of the gates (52). In the case illustrated in FIG. 8, the maximum angle of the cutting tool (110) is 150 degrees. Thus, even if the special 5-axis machining center (100) in which the relative angle θ of the cutting tool (110) with respect to the center axis (33) of the screw rotor (30) is within an operating range up to 145 degrees is used, the interference between the spindle (101) and the rotary table (104) cannot be avoided.

Figure 9:
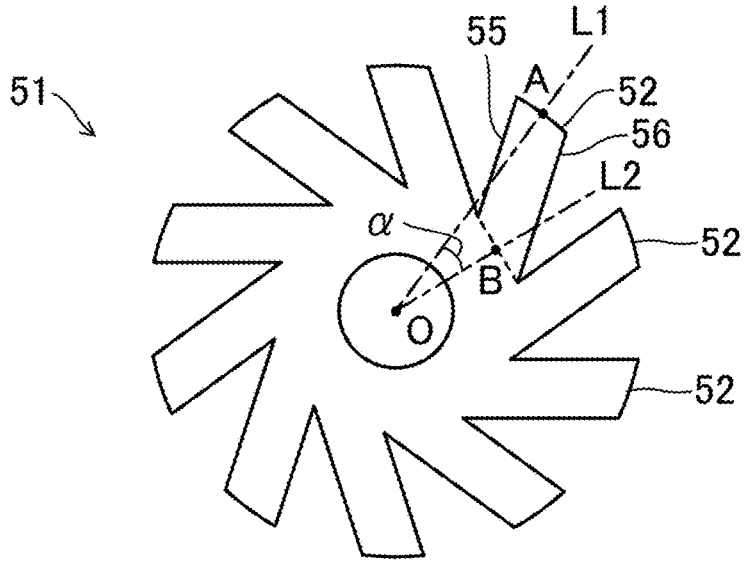
FIG. 9 is a plan view illustrating a configuration of each of the gate rotors.

Next, the shape of each of the gates (52) according to the present embodiment will be described. As illustrated in FIG. 9, each of the gate rotors (51) includes the gates (52) that mesh with the helical grooves (40) of the screw rotor (30). Each of the gates (52) includes the first seal line (55) and the second seal line (56) that come into contact with the side wall surfaces (41) of the helical grooves (40) of the screw rotor (30).

In each of the gates (52), the shape of the first seal line (55) and the shape of the second seal line (56) are asymmetric with respect to the first imaginary straight line (L1) passing through the rotation center (O) of the corresponding gate rotor (51) and the first intermediate position (A) located on the tip end side of the gate (52) between the first seal line (55) and the second seal line (56).

In addition, the second imaginary straight line (L2) passing through the rotation center (O) of the corresponding gate rotor (51) and the second intermediate position (B) located on the base end side of the gate (52) between the first seal line (55) and the second seal line (56) is inclined at a predetermined angle with respect to the first imaginary straight line (L1). An angle formed by the first imaginary straight line (L1) and the second imaginary straight line (L2) will be referred to as an angle α.

Figure 10:
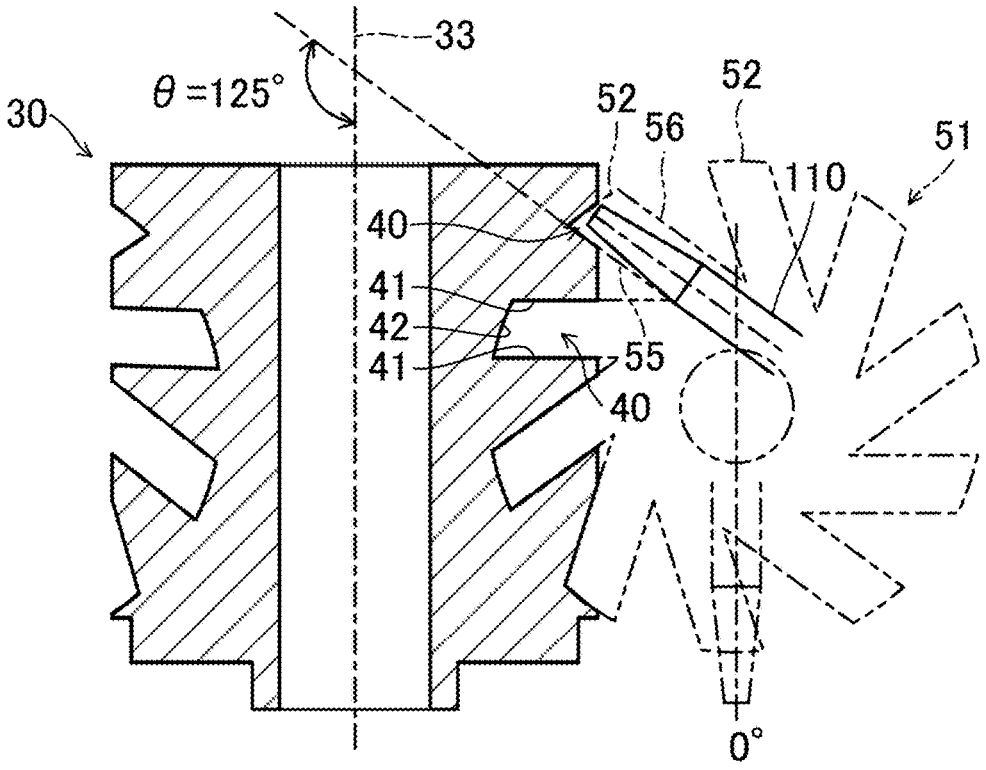
FIG. 10 is a plan view illustrating a relative angle of the cutting tool with respect to the center axis of the screw rotor.

As illustrated in FIG. 10, the groove machining step of forming the helical grooves (40), whose shapes correspond to the gates (52), into a cylindrical workpiece is performed. After the groove machining step, the finishing step is performed on the side wall surfaces (41) and the bottom wall surfaces (42) of the helical grooves (40) such that the shapes of the helical grooves (40) each meet the design values of the screw rotor (30). In the finishing step, swarf machining in which the screw rotor (30) is cut by using the side surface of the cutting tool (110) is performed.

Here, as illustrated in FIG. 10, assume that the relative angle θ of the cutting tool (110) with respect to the center axis (33) of the screw rotor (30) is 0 degrees when the center axis of the cutting tool (110) and the center axis (33) of the screw rotor (30) are parallel to each other while the tip of the cutting tool (110) faces downward in FIG. 10.

Here, when viewed in an axial direction of the gate rotor (51), a maximum angle formed by the center axis (33) of the screw rotor (30) and a surface included in the side wall surfaces (41) of the helical grooves (40), the surface being configured to come into contact with the first seal line (55) of one of the gates (52), that is, the maximum angle of the cutting tool (110) when machining the axial end portion of the screw rotor (30), corresponds to the shape of the gate (52). In the case illustrated in FIG. 10, the angle α formed by the first imaginary straight line (L1) and the second imaginary straight line (L2) in each of the gates (52) is designed such that the maximum angle of the cutting tool (110) is 125 degrees.

As described above, when each of the gates (52) has the shape illustrated in FIG. 9 and FIG. 10, the finishing step is performed with the relative angle θ of the cutting tool (110) within the range of 25 degrees to 125 degrees. As a result, the interference between the spindle (101) and the rotary table (104) can be avoided when machining each of the helical grooves (40) by using the 5-axis machining center (100).

Figure 11:
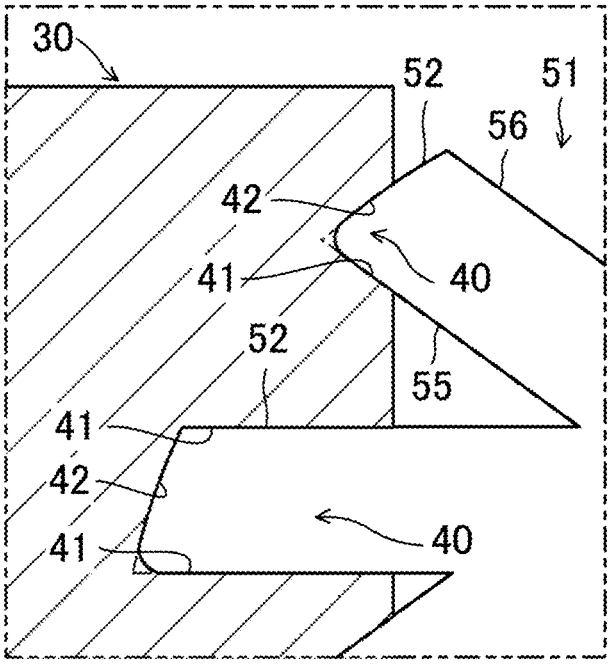
FIG. 11 is a diagram illustrating the shapes of corner portions between side wall surfaces of helical grooves and bottom wall surfaces of the helical grooves.

Here, as illustrated in FIG. 11, corner portions between the side wall surfaces (41) of the helical grooves (40) that come into contact with the first seal lines (55) of the gates (52) and the bottom wall surfaces (42) of the helical grooves (40) each have an acute angle, and they cannot be processed at an acute angle. Thus, the corner portions between the side wall surfaces (41) and the bottom wall surfaces (42) of the helical grooves (40) are each formed into a curved shape by using a taper end mill. For example, the curvature of each of the curved shapes connecting the side wall surfaces (41) to their respective bottom wall surfaces (42) may be equivalent to the outer diameter of each of the gate rotors (51). Note that it is also necessary to chamfer corner portions of the gates (52) on the tip end side in accordance with the curved shapes of the corner portions of the helical grooves (40).

Advantageous Effects of Embodiment

According to the features of the present embodiment, in each of the gates (52), the first seal line (55) and the second seal line (56) are asymmetric with respect to the first imaginary straight line (L1) passing through the rotation center (O) of a corresponding one of the gate rotors (51) and the first intermediate position (A) located on the tip end side of the gate (52) between the first seal line (55) and the second seal line (56), and each of the helical grooves (40) has a shape corresponding to the gate (52). As described above, by refining the shape of each of the gates (52), the interference between the spindle (101) and the rotary table (104) can be avoided when machining each of the helical grooves (40), which correspond to the gates (52), by using the 5-axis machining center (100).

According to the features of the present embodiment, the second imaginary straight line (L2) passing through the rotation center (O) of the corresponding gate rotor (51) and the second intermediate position (B) located on the base end side of the gate (52) between the first seal line (55) and the second seal line (56) is inclined at a predetermined angle with respect to the first imaginary straight line (L1). As described above, by refining the shape of each of the gates (52), the interference between the spindle (101) and the rotary table (104) can be avoided when machining each of the helical grooves (40), which correspond to the gates (52), by using the 5-axis machining center (100).

According to the features of the present embodiment, the corner portions between the bottom wall surfaces (42) and the side wall surfaces (41) of the helical grooves (40) each have a curved shape, so that the helical grooves (40) can be formed by using a taper end mill.

According to the features of the present embodiment, the helical grooves (40) can be formed between the first seal end portion (31) and the second seal end portion (32) even in the case where the screw rotor (30) has seal surfaces at the two axial ends thereof.

According to the features of the present embodiment, the screw compressor (10) and the refrigerant circuit (1*a*) through which the refrigerant compressed by the screw compressor (10) flows are provided. As a result, the refrigeration apparatus (1) including the screw compressor (10) can be provided.

Second Embodiment

In the following description, portions that are the same as those of the above-described first embodiment will be denoted by the same reference signs, and only differences will be described.

Figure 12:
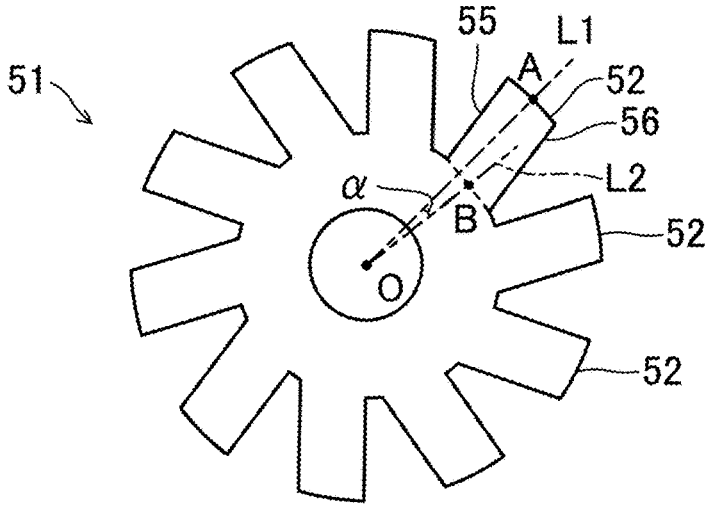
FIG. 12 is a plan view illustrating a configuration of a gate rotor according to a second embodiment.

As illustrated in FIG. 12, each of the gate rotors (51) includes the gates (52) that mesh with the helical grooves (40) of the screw rotor (30). Each of the gates (52) includes the first seal line (55) and the second seal line (56) that come into contact with the side wall surfaces (41) of the helical grooves (40) of the screw rotor (30).

In each of the gates (52), the shape of the first seal line (55) and the shape of the second seal line (56) are asymmetric with respect to the first imaginary straight line (L1) passing through the rotation center (O) of the corresponding gate rotor (51) and the first intermediate position (A) located on the tip end side of the gate (52) between the first seal line (55) and the second seal line (56).

In addition, the second imaginary straight line (L2) passing through the rotation center (O) of the corresponding gate rotor (51) and the second intermediate position (B) located on the base end side of the gate (52) between the first seal line (55) and the second seal line (56) is inclined at a predetermined angle with respect to the first imaginary straight line (L1). The angle formed by the first imaginary straight line (L1) and the second imaginary straight line (L2) will be referred to as the angle α.

Figure 13:
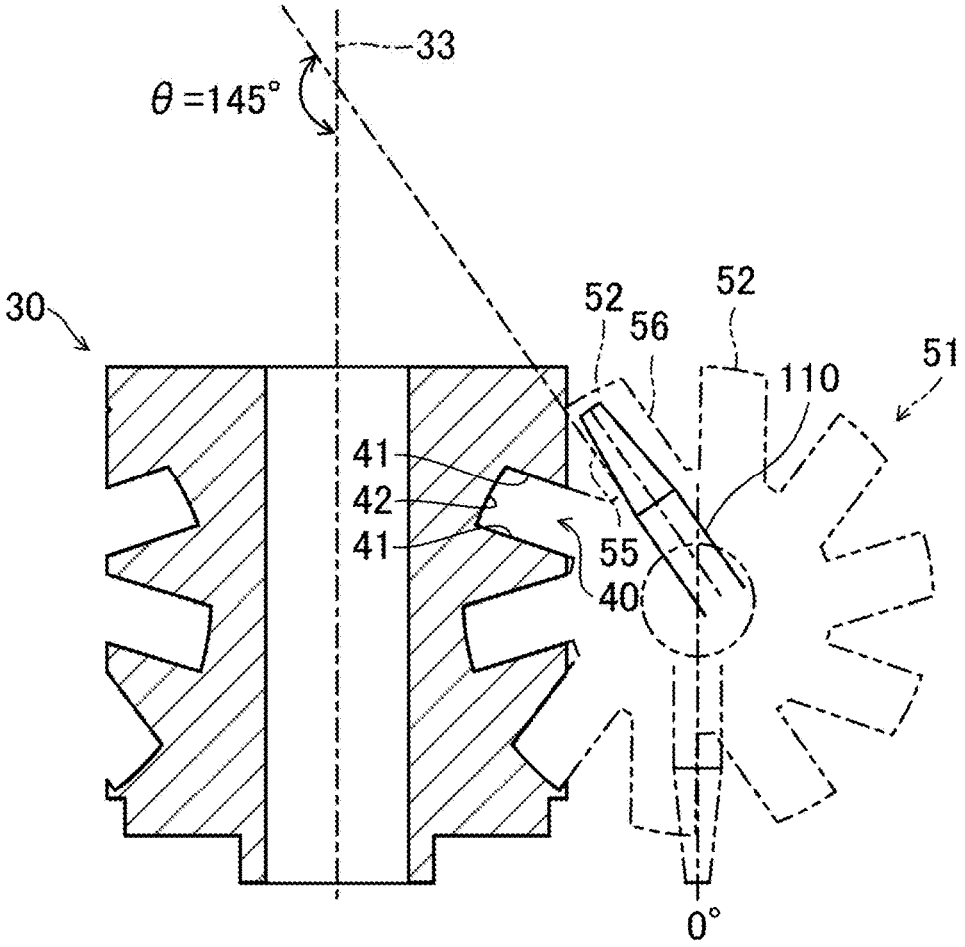
FIG. 13 is a plan view illustrating a relative angle of the cutting tool with respect to the center axis of the screw rotor.

As illustrated in FIG. 13, assume that the relative angle θ of the cutting tool (110) with respect to the center axis (33) of the screw rotor (30) is 0 degrees when the center axis of the cutting tool (110) and the center axis (33) of the screw rotor (30) are parallel to each other while the tip of the cutting tool (110) faces downward in FIG. 13.

The maximum angle of the cutting tool (110) when machining the axial end portion of the screw rotor (30) corresponds to the shape of each of the gates (52). In the case illustrated in FIG. 13, the angle α formed by the first imaginary straight line (L1) and the second imaginary straight line (L2) in each of the gates (52) is designed such that the maximum angle of the cutting tool (110) is 145 degrees. The angle α in each of the gates (52) illustrated in FIG. 12 is smaller than the angle α in each of the gates (52) of the first embodiment in which the maximum angle of the cutting tool (110) is 125 degrees.

As described above, when each of the gates (52) has the shape illustrated in FIG. 12 and FIG. 13, the finishing step is performed with the relative angle θ of the cutting tool (110) within the range of 25 degrees to 145 degrees. As described above, by setting the maximum angle of the cutting tool (110) to be 145 degrees or less, the interference between the spindle (101) and the rotary table (104) can be avoided when machining each of the helical grooves (40), which correspond to the gates (52), by using the 5-axis machining center (100).

Third Embodiment

Figure 14:
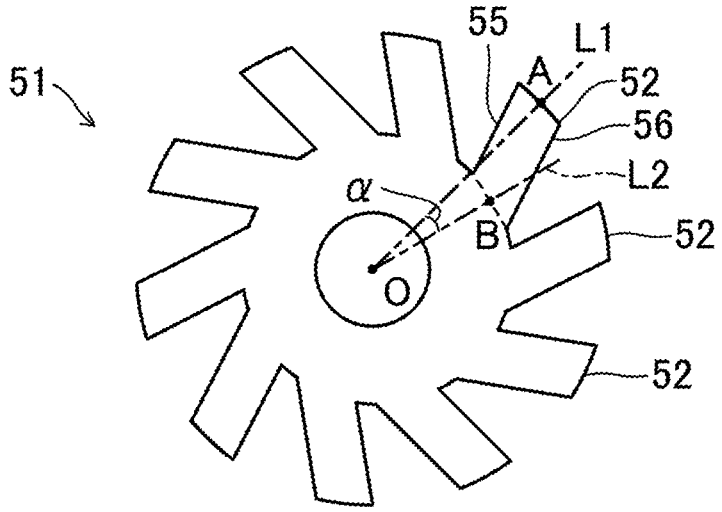
FIG. 14 is a plan view illustrating the configuration of the gate rotor according to a third embodiment.

As illustrated in FIG. 14, each of the gate rotors (51) includes the gates (52) that mesh with the helical grooves (40) of the screw rotor (30). Each of the gates (52) includes the first seal line (55) and the second seal line (56) that come into contact with the side wall surfaces (41) of the helical grooves (40) of the screw rotor (30).

In each of the gates (52), the shape of the first seal line (55) and the shape of the second seal line (56) are asymmetric with respect to the first imaginary straight line (L1) passing through the rotation center (O) of the corresponding gate rotor (51) and the first intermediate position (A) located on the tip end side of the gate (52) between the first seal line (55) and the second seal line (56).

In addition, the second imaginary straight line (L2) passing through the rotation center (O) of the corresponding gate rotor (51) and the second intermediate position (B) located on the base end side of the gate (52) between the first seal line (55) and the second seal line (56) is inclined at a predetermined angle with respect to the first imaginary straight line (L1). The angle formed by the first imaginary straight line (L1) and the second imaginary straight line (L2) will be referred to as the angle α.

Figure 15:
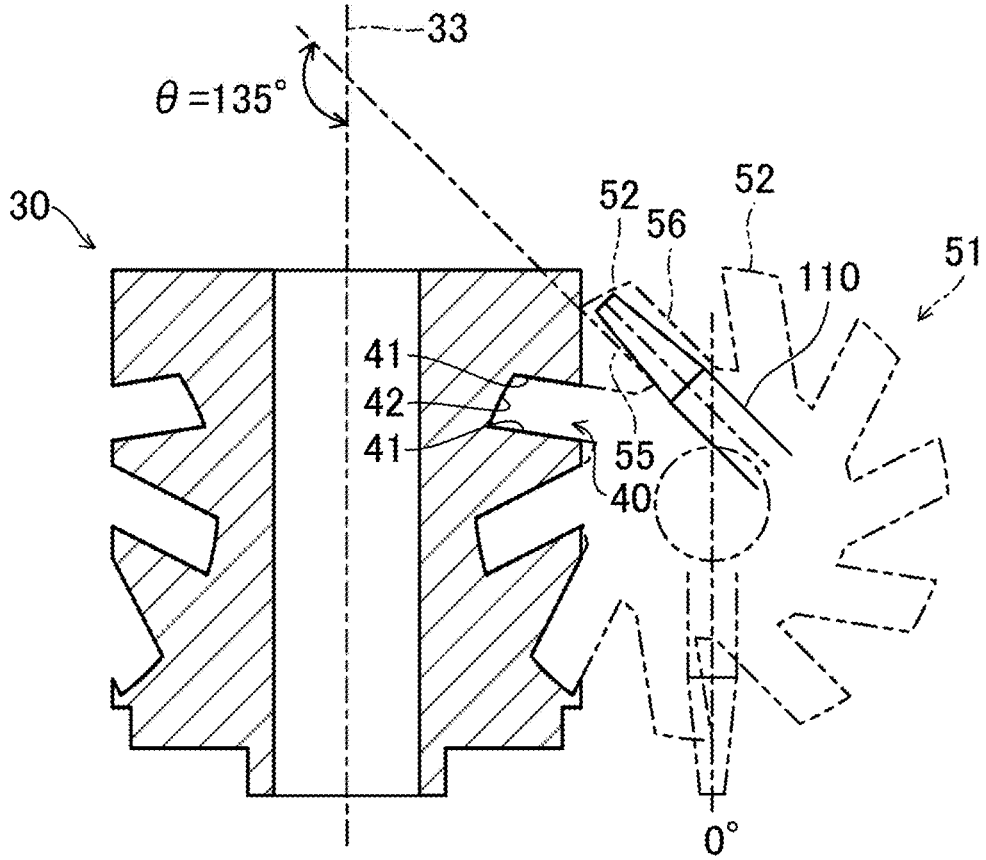
FIG. 15 is a plan view illustrating a relative angle of the cutting tool with respect to the center axis of the screw rotor.

As illustrated in FIG. 15, assume that the relative angle θ of the cutting tool (110) with respect to the center axis (33) of the screw rotor (30) is 0 degrees when the center axis of the cutting tool (110) and the center axis (33) of the screw rotor (30) are parallel to each other while the tip of the cutting tool (110) faces downward in FIG. 15.

The maximum angle of the cutting tool (110) when machining the axial end portion of the screw rotor (30) corresponds to the shape of each of the gates (52). In the case illustrated in FIG. 15, the angle α formed by the first imaginary straight line (L1) and the second imaginary straight line (L2) in each of the gates (52) is designed such that the maximum angle of the cutting tool (110) is 135 degrees. The angle α in each of the gates (52) illustrated in FIG. 14 is smaller than the angle α in each of the gates (52) of the first embodiment in which the maximum angle of the cutting tool (110) is 125 degrees and is larger than the angle α in each of the gates (52) of the second embodiment in which the maximum angle of the cutting tool (110) is 145 degrees.

As described above, when each of the gates (52) has the shape illustrated in FIG. 14 and FIG. 15, the finishing step is performed with the relative angle θ of the cutting tool (110) within the range of 25 degrees to 135 degrees. As described above, by setting the maximum angle of the cutting tool (110) to be 135 degrees or less, the interference between the spindle (101) and the rotary table (104) can be avoided when machining each of the helical grooves (40), which correspond to the gates (52), by using the 5-axis machining center (100).

Fourth Embodiment

Figure 16:
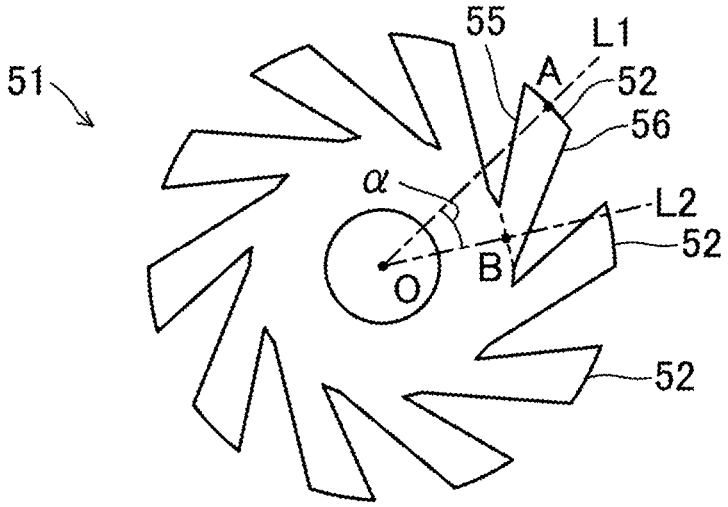
FIG. 16 is a plan view illustrating a configuration of a gate rotor according to a fourth embodiment.

As illustrated in FIG. 16, each of the gate rotors (51) includes the gates (52) that mesh with the helical grooves (40) of the screw rotor (30). Each of the gates (52) includes the first seal line (55) and the second seal line (56) that come into contact with the side wall surfaces (41) of the helical grooves (40) of the screw rotor (30).

In each of the gates (52), the shape of the first seal line (55) and the shape of the second seal line (56) are asymmetric with respect to the first imaginary straight line (L1) passing through the rotation center (O) of the corresponding gate rotor (51) and the first intermediate position (A) located on the tip end side of the gate (52) between the first seal line (55) and the second seal line (56).

In addition, the second imaginary straight line (L2) passing through the rotation center (O) of the corresponding gate rotor (51) and the second intermediate position (B) located on the base end side of the gate (52) between the first seal line (55) and the second seal line (56) is inclined at a predetermined angle with respect to the first imaginary straight line (L1). The angle formed by the first imaginary straight line (L1) and the second imaginary straight line (L2) will be referred to as the angle α.

Figure 17:
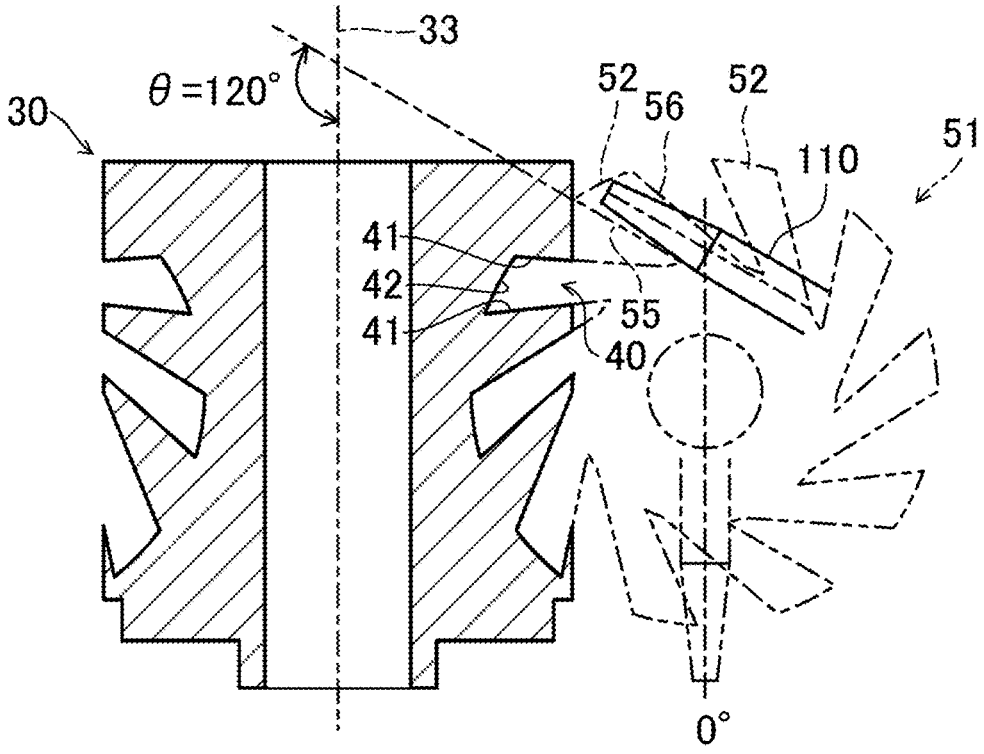
FIG. 17 is a plan view illustrating a relative angle of the cutting tool with respect to the center axis of the screw rotor.

As illustrated in FIG. 17, assume that the relative angle θ of the cutting tool (110) with respect to the center axis (33) of the screw rotor (30) is 0 degrees when the center axis of the cutting tool (110) and the center axis (33) of the screw rotor (30) are parallel to each other while the tip of the cutting tool (110) faces downward in FIG. 17.

The maximum angle of the cutting tool (110) when machining the axial end portion of the screw rotor (30) corresponds to the shape of each of the gates (52). In the case illustrated in FIG. 17, the angle α formed by the first imaginary straight line (L1) and the second imaginary straight line (L2) in each of the gates (52) is designed such that the maximum angle of the cutting tool (110) is 120 degrees. The angle α in each of the gates (52) illustrated in FIG. 16 is larger than the angle α in each of the gates (52) of the first embodiment in which the maximum angle of the cutting tool (110) is 125 degrees.

As described above, when each of the gates (52) has the shape illustrated in FIG. 16 and FIG. 17, the finishing step is performed with the relative angle θ of the cutting tool (110) within the range of 25 degrees to 120 degrees. As described above, by setting the maximum angle of the cutting tool (110) to be 120 degrees or less, the interference between the spindle (101) and the rotary table (104) can be avoided when machining each of the helical grooves (40), which correspond to the gates (52), by using the 5-axis machining center (100).

Although the embodiments and the modifications have been described above, it is to be understood that various modifications can be made to the embodiments and the details without departing from the gist and the scope of the claims. In addition, the elements according to the above-described embodiments, modifications, and other embodiments may be appropriately combined or replaced. Furthermore, in the specification and the claims, the terms "first", "second", "third", and the like are used to distinguish between the terms to which they refer, and are not intended to limit the number or order of those terms.

As described above, the present disclosure is useful for a screw compressor and a refrigeration apparatus.

The invention claimed is:

1. A screw compressor comprising:

a screw rotor having a plurality of helical grooves; and a gate rotor including gates configured to mesh with the helical grooves of the screw rotor, each of the gates having a first seal line and a second seal line, with each configured to come into contact with a plurality of side wall surfaces of the helical grooves of the screw rotor, a shape of the first seal line and a shape of the second seal line being asymmetric with respect to a first straight line passing through a rotation center of the gate rotor and a first intermediate position located on a tip end side of each of the gates between the first seal line and the second seal line, the first intermediate position being substantially centrally located on the tip end side of a respective gate, a second straight line passing through the rotation center of the gate rotor and a second intermediate position located on a base end side of each of the gates between the first seal line and the second seal line, the second straight line being inclined at a predetermined angle with respect to the first straight line, the second intermediate position being substantially centrally located on the base end side of the respective gate, and each of the helical grooves having a shape corresponding to each of the gates, the first straight line not passing through a base end side of the respective gate as seen from an axial direction of the gate rotor.

2. The screw compressor according to claim 1, wherein an angle $\alpha$ is formed by the first straight line and the second straight line, a maximum angle, as seen from an axial direction of the gate rotor, formed by a center axis of the screw rotor and the plurality of side wall surfaces that are configured to come into contact with the first seal line in the helical grooves decreases as the angle $\alpha$ increases, and the maximum angle is 145 degrees or less.

3. The screw compressor according to claim 2, wherein the maximum angle is 135 degrees or less.

4. The screw compressor according to claim 3, wherein the maximum angle is 120 degrees or less.

5. The screw compressor according to claim 1, wherein, in each of the helical grooves, a corner portion between a bottom wall surface and a side wall surface of the plurality of side wall surfaces is formed in a curved shape.

6. The screw compressor according to claim 1, wherein, in an axial direction of the screw rotor, a first seal end portion is provided at one end of the screw rotor, and a second seal end portion is provided at an other end of the screw rotor, and the helical grooves are formed between the first seal end portion and the second seal end portion.

7. A refrigeration apparatus including the screw compressor according to claim 1, the refrigeration apparatus further comprising:

a refrigerant circuit configured to allow a refrigerant compressed by the screw compressor to flow therethrough.

* * * * *